US010480353B2

(12) United States Patent
Cook et al.

(10) Patent No.: US 10,480,353 B2
(45) Date of Patent: Nov. 19, 2019

(54) CRYOGENIC POWER EXTRACTION

(71) Applicant: University of Florida Research Foundation, Inc., Gainesville, FL (US)

(72) Inventors: Charles R. Cook, Gainesville, FL (US); William E. Lear, Jr., Portland, OR (US)

(73) Assignee: UNIVERSITY OF FLORIDA RESEARCH FOUNDATION, INC., Gainesville, FL (US)

( * ) Notice: Subject to any disclaimer, the term of this patent is extended or adjusted under 35 U.S.C. 154(b) by 0 days.

(21) Appl. No.: 15/119,655

(22) PCT Filed: Feb. 17, 2015

(86) PCT No.: PCT/US2015/016142

§ 371 (c)(1),
(2) Date: Aug. 17, 2016

(87) PCT Pub. No.: WO2015/126821

PCT Pub. Date: Aug. 27, 2015

(65) Prior Publication Data

US 2017/0009607 A1 Jan. 12, 2017

Related U.S. Application Data

(60) Provisional application No. 61/942,998, filed on Feb. 21, 2014.

(51) Int. Cl.
*F17C 9/04* (2006.01)
*F01K 23/10* (2006.01)
(Continued)

(52) U.S. Cl.
CPC ..... *F01K 23/101* (2013.01); *F01D 15/005* (2013.01); *F01D 15/10* (2013.01); *F01K 5/02* (2013.01); *F17C 9/04* (2013.01)

(58) Field of Classification Search
CPC . F01K 5/02; F01K 23/101; F17C 9/04; F01D 15/005
See application file for complete search history.

(56) References Cited

U.S. PATENT DOCUMENTS 5,095,709 A 3/1992 Billiot
5,327,987 A * 7/1994 Abdelmalek ..... B60K 6/24 180/65.25

(Continued)

FOREIGN PATENT DOCUMENTS

DE 102005025615 A1 12/2006
WO 2013/046970 4/2013

OTHER PUBLICATIONS

DE 102005025615 A1 Translation.*

(Continued)

*Primary Examiner* — Brian M King
(74) *Attorney, Agent, or Firm* — Thomas Horstemeyer, LLP

(57) ABSTRACT

Various examples are provided for cryogenic power extraction. In one example, among others, a system for cryogenic power extraction includes a heat exchanger that can heat a cryogenic working fluid using exhaust heat from a heat source, and a turbine that can generate power from the heated cryogenic working fluid. In another example, a method includes heating a cryogenic working fluid with waste heat from a heat source and driving a turbine with the heated cryogenic working fluid. Power produced by the turbine can be used drive a mechanical load and/or generate electricity for use by an electrical load. For example, waste heat from a combustion engine of a vehicle can be used to generate power for driving mechanical loads of the engine and/or to generate electricity for charging a battery of the vehicle.

16 Claims, 6 Drawing Sheets

(51) Int. Cl.

| | |
|---|---|
| ***F01D 15/00*** | (2006.01) |
| ***F01D 15/10*** | (2006.01) |
| ***F01K 5/02*** | (2006.01) |

(56) References Cited

U.S. PATENT DOCUMENTS

| | | | | |
|---|---|---|---|---|
| 7,854,278 | B2 | 12/2010 | Kaufman | |
| 8,499,874 | B2 | 8/2013 | Dewis et al. | |
| 2008/0276610 | A1* | 11/2008 | McDowell | B60K 6/26 60/517 |
| 2009/0211242 | A1 | 8/2009 | Dearman | |
| 2009/0282840 | A1* | 11/2009 | Chen | F01D 15/005 62/50.3 |
| 2010/0101240 | A1* | 4/2010 | Mak | F17C 9/02 62/50.2 |
| 2010/0116484 | A1* | 5/2010 | Kokubo | F25D 17/02 165/201 |
| 2011/0202226 | A1* | 8/2011 | Welchko | B60L 3/0038 701/31.4 |

OTHER PUBLICATIONS

WO 2013046970 A1 Translation.*
International Search Report for PCT/US2015/016142 dated May 18, 2015.
Translation of the Abstract for DE 102005025615 published on Dec. 7, 2006.
Translation of the Abstract for WO 2013/046970 published on Apr. 4, 2013.

* cited by examiner

CRYOGENIC POWER EXTRACTION

CROSS REFERENCE TO RELATED APPLICATIONS

This application is the 35 U.S.C. § 371 national stage application of PCT Application No. PCT/US2015/016142, filed Feb. 17, 2015, which claims priority to, and the benefit of, co-pending U.S. provisional application entitled "CRYOGENIC POWER EXTRACTION" having Ser. No. 61/942,998, filed Feb. 21, 2014, both of which are hereby incorporated by reference in their entirety.

BACKGROUND

Fuels such as gasoline and diesel oil are burnt in combustion engines to release the stored energy to generate mechanical power. Even in efficient combustion engines, up to two thirds of the released energy is exhausted as waste heat, the majority of which is released to the environment. For example, about 60% of the energy can be lost for large diesel engines and as much as 90% can be lost for small gasoline engines.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 1, 5, 5A and 5B are graphical representations of examples of a cryogenic power extraction system in accordance with various embodiments of the present disclosure.

DETAILED DESCRIPTION

Figure 1:
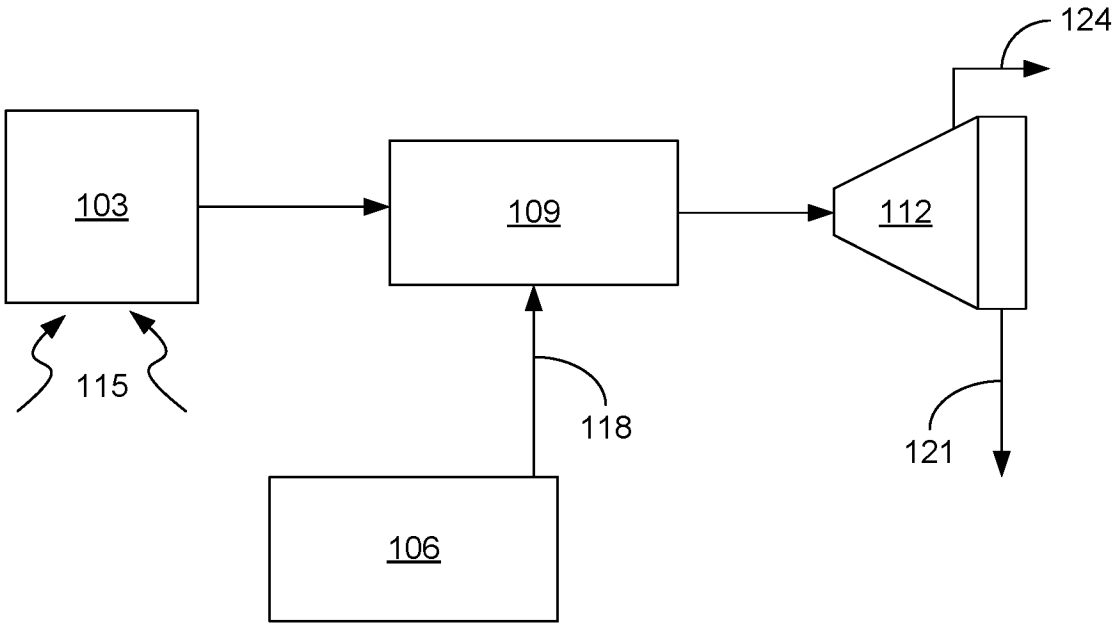

Disclosed herein are various embodiments of methods related to cryogenic power extraction. Reference will now be made in detail to the description of the embodiments as illustrated in the drawings, wherein like reference numbers indicate like parts throughout the several views.

Waste heat from combustion engines (e.g., gasoline and/or diesel engines), or other sources, can be used to generate power using a turbine in a modified Brayton cycle. In an ideal Brayton cycle, a working fluid goes through four stages: isentropic compression, constant pressure heating (combustion of fuel in air), isentropic expansion, and then a constant pressure cooling back to ambient conditions. The cooling stage is used to close the cycle by allowing the working fluid to be recompressed. Generally, the working fluid is not cooled within the system, but is cooled by an external cooling source. This process is used in the generation of electric power. For example, in a coal-fired power plant, burning coal heats the fluid and water cooling towers are used to cool the fluid back down.

Referring to FIG. 1, shown is a graphical representation of an example of a cryogenic power extraction system 100 in accordance with various embodiments of the present disclosure. The cryogenic power extraction system 100 can be used to increase the efficiencies of vehicles such as, e.g., standard or hybrid vehicles using combustion engines. In the example of FIG. 1, the system 100 includes a storage tank 103 for storing the working fluid, a heat source 106 such as, e.g., a combustion engine, an exhaust heat exchanger 109 and a turbine such as, e.g., a turbine generator 112. Heating air with the waste heat generated by the heat source 106 produces no work. Instead, a cryogenic fluid such as liquid nitrogen (LN2), liquid natural gas (LNG), liquid hydrogen (LH2), or liquid air can be used as the working fluid. For example, LN2 can be stored as the working fluid in the storage tank 103. The value in using LN2 is the potential energy contained within it from the pumping process that brought it to cryogenic temperatures. This work (i.e., the pumping work already applied to the LN2) is what is extracted from the Brayton cycle. This may also be considered as providing a low temperature sink for the combined cycle, where the cryogenic power extraction system 100 operates due to the temperature difference between the cryogenic fluid and the rejection temperature from the Otto cycle of a heat source 106 such as a combustion engine.

The storage tank 103 may be insulated to aid in maintaining fluid temperature. Even with insulation, ambient heating 115 of a working fluid of LN2 can generate sufficient head pressure in the storage tank 103 (or self-pressurize) to drive the system 100. For example, pressures of up to 10 atmospheres or more can occur with even minimal ambient heating of the LN2. In some embodiments, a pressure relief valve may be included on the storage tank 103 to limit the tank pressure. The tank head pressure forces the working fluid to the heat exchanger. In some implementations, a pump can be included to provide sufficient head pressure with the working fluid. The amount of working fluid supplied from the storage tank 103 may be controlled using an adjustable throttle valve or other appropriate controllable supply device. System controls can monitor system conditions such as, e.g., temperatures, pressures, load conditions, etc., and adjust the work fluid being supplied to improve heat extraction from the exhaust of the heat source 106 or control power generation by the turbine generator 112. For instance, the heat applied to the cryogenic fluid can be varied and/or a variable area turbine can be used to control use of the working fluid.

Waste heat in the exhaust 118 from the heat source 106 can be used to warm the working fluid. For instance, LN2 can be warmed from 77 K through the exhaust heat exchanger 109 to near the exhaust temperature of a combustion engine. Heating a cryogenic fluid with the exhaust heat from a heat source 106 such as, e.g., a combustion engine converts the fluid to a high temperature gas. Raising a cryogen such as, e.g., LN2 to a high temperature creates a dramatic increase in pressure, if contained. For example, simply containing LN2 in an enclosed vessel and allowing it to rise to room temperature can result in a pressure of nearly 43,000 PSI. Heating LN2 with the exhaust heat will boil the LN2 and convert it into a high temperature gas, where a turbine generator 112 may extract useful work from the fluid. The storage tank 103 can be filled (or refilled) with cryogenic fluid by pumping the cryogenic fluid into the storage tank 103 under pressure or by pouring the cryogenic fluid into the storage tank 103 after the tank pressure has been released. For example, if LN2 in the storage tank 103 is maintained at 10 psig, then additional LN2 can be added by pumping the cryogenic fluid into the storage tank 103 at a higher pressure or by venting the storage tank 103 to atmospheric pressure before adding the cryogenic fluid.

A turbine supplied with the heated working fluid can be configured to produce mechanical and/or electrical power outputs. In some embodiments, mechanical power can be supplied through a shaft of the turbine to drive mechanical equipment such as, but not limited to, a compressor, fan, pump, generator and/or other mechanical load. For example, the mechanical power produced by the turbine can be used to do work on another fluid and/or compress air. When driving a generator, electric power 121 can be generated by the turbine generator 112 and used to charge the battery or supply other electrical loads. In some implementations, the amount of LN2 supplied from the storage tank 103 may be controlled to improve or maximize the energy extraction. In some implementations, the amount of LN2 supplied from the storage tank 103 may be controlled to improve or maximize the energy extraction or power storage. After the energy is extracted from the nitrogen gas by the turbine generator 112, the nitrogen gas can be vented 124 to the atmosphere.

Figure 2:
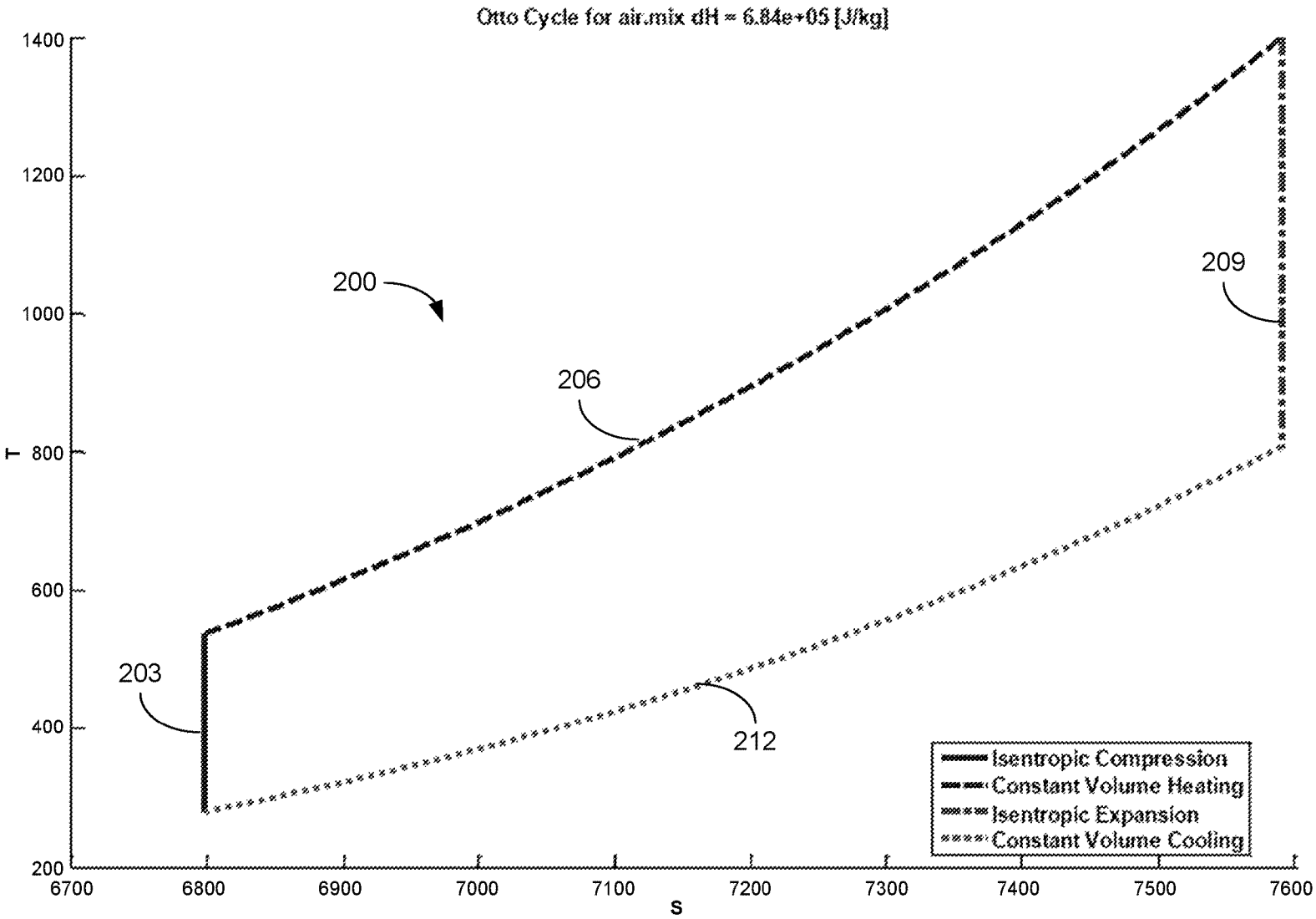
FIGS. 2 and 3 are plots illustrating examples of ideal Otto and Brayton cycles, respectively, in accordance with various embodiments of the present disclosure.
Figure 3:
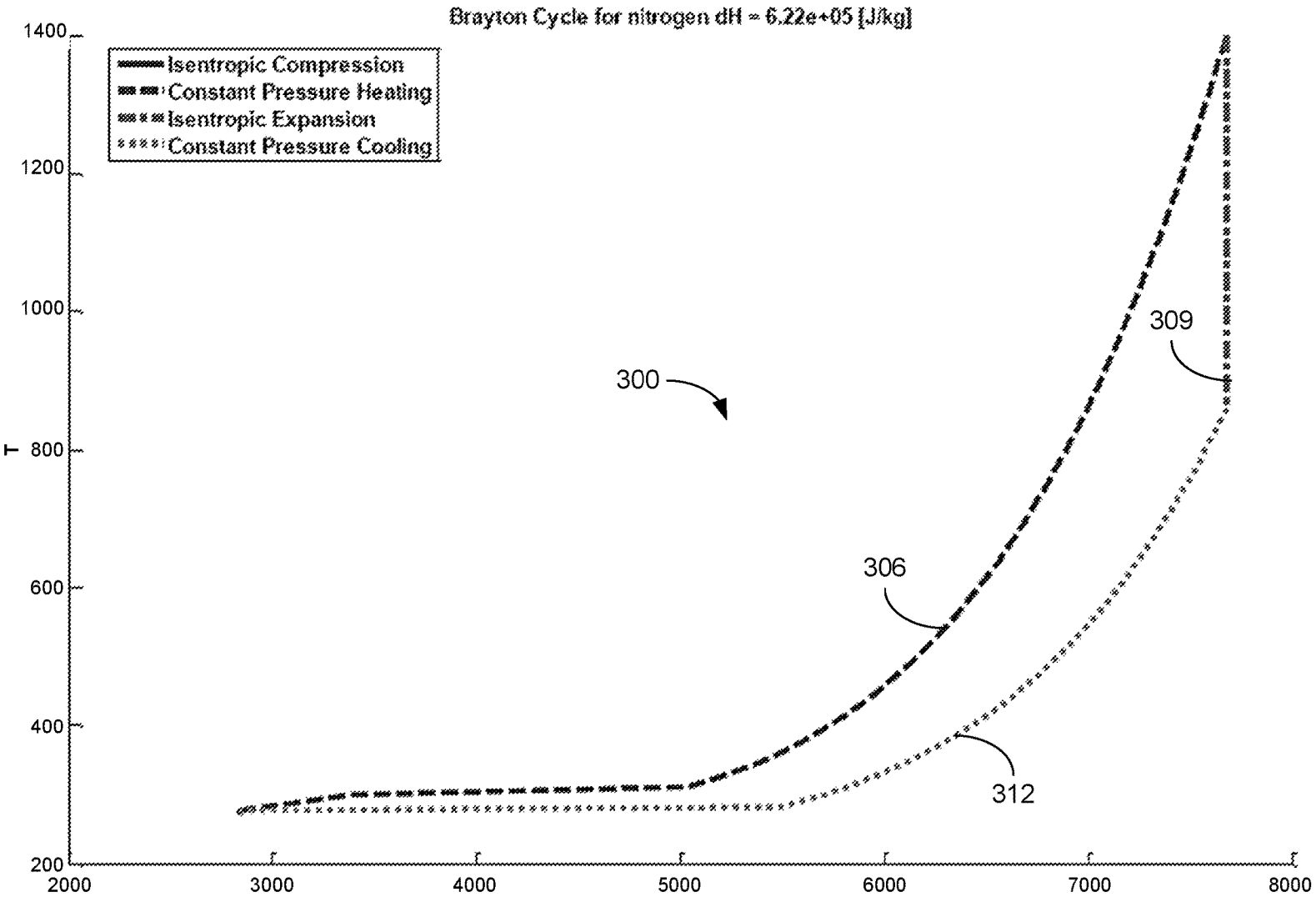

FIG. 2 shows an example of an ideal Otto cycle 200 demonstrating the cycle power density for an air mixture. The Otto cycle 200 includes isentropic compression 203, constant volume heating 206, isentropic expansion 209, and constant volume cooling 212. FIG. 3 shows an example of an ideal Brayton cycle 300 demonstrating the cycle power density for LN2. As illustrated in FIG. 3, the Brayton cycle 300 includes constant pressure heating 306, isentropic expansion 309, and constant pressure cooling 312. Isentropic compression is not visible in the plotted cycle. As can be seen from FIG. 3, the LN2 Brayton cycle is a viable source of power. However, the balance of power production in the heat source and the LN2 Brayton cycle must be considered along with the cost of the LN2.

In the Brayton cycle 300 of FIG. 3, heating the LN2 to 1200 K uses 185 kJ/kg of heat. In contrast, the air mixture in the Otto cycle 200 of FIG. 2 has gained 400 kJ/kg of thermal energy when exhausted, which is more than twice the thermal density needed for the Brayton cycle 300. Assuming, for example, a heat exchanger efficiency of 46%, the exhaust mass flow rate is matched with the LN2 mass flow rate. However, the LN2 and the fuel are stored for the Brayton cycle 300, while only the fuel, but not the air, is stored in the Otto cycle 200.

Assuming that the fuel produces 3 MJ/kg of heat when burned in the air mixture and neglecting the effect of the fuel in the air mixture, with the ideal Otto cycle 200 utilizing 914 J/kg of heating, roughly 3 kg of air mixture are produced with 1 kg of fuel. This would result in a LN2 mass requirement at three times the fuel mass requirement. Since the mass flow rates of the two systems have been matched, the two power densities add to 1.3 MJ/2 kg (or 0.65 MJ/kg), which is 65% of the power density of the Otto cycle 200 at the cost of flowing three parts LN2 per one part fuel with a price of LN2 of $0.30/liter or $1.10/gallon.

Assuming a price per gallon of fuel of $3.50, the price of the LN2/fuel mixture per gallon would be $1.70=($3.50+3*$1.10)/4. With the 65% combined power density of the Brayton cycle 300, the cost to produce the same power per gallon of fuel would be reduced to $2.62 per gallon. Three fourths of the power comes from a completely renewable, non-polluting, source since the LN2 is extracted from the atmosphere. Even though the combined LN2/fuel mixture is 65% as efficient as the fuel mixture, it uses only one part fuel to three parts LN2. This would make the miles per gallon of fuel about 2.6 times higher in a vehicle utilizing the combined mixture. For instance, a car that achieves 55 mpg with only fuel could achieve 143 mpg with the combined LN2/fuel mixture while enjoying about $0.88/gallon in savings.

Figure 4:
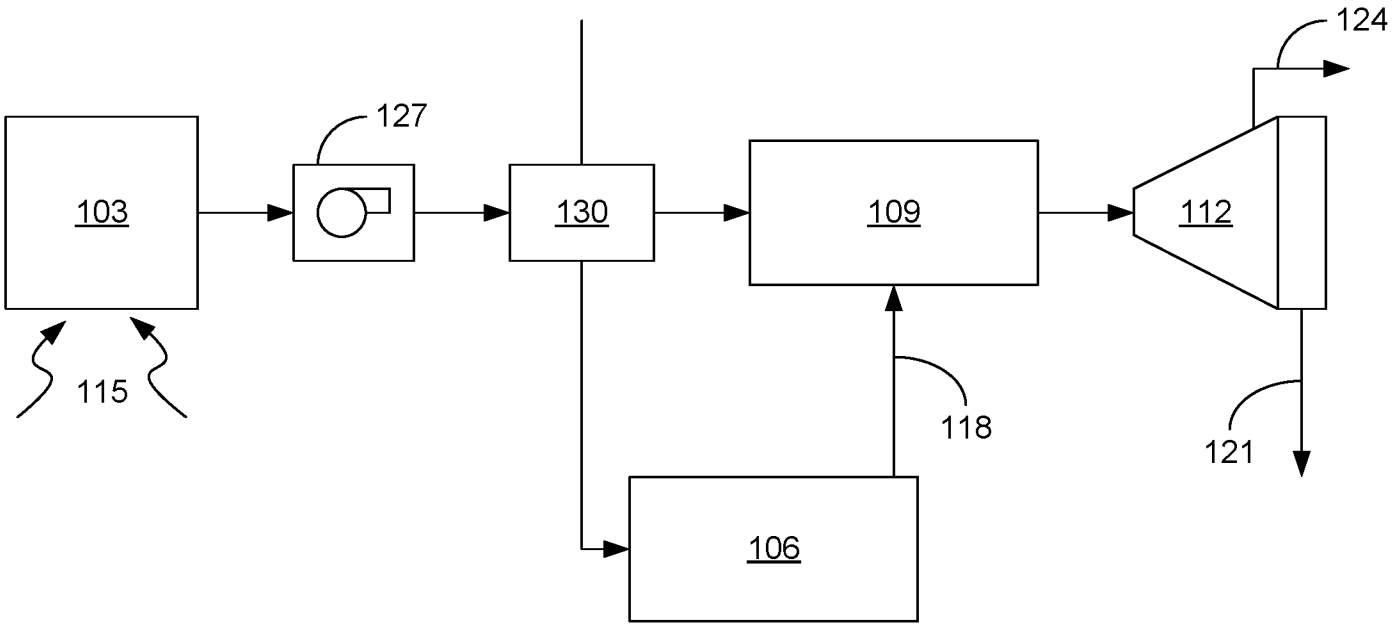

Referring to FIG. 4, shown is another example of the cryogenic power extraction system 100. As previously discussed, a pump 127 can be included in the supply line from the storage tank 103 to increase the head pressure of the working fluid. Fuel efficiency of the heat source such as a combustion engine can be increased by precooling (or pre-chilling) the incoming air. In the example of FIG. 4, a precooling heat exchanger 130 can be used to cool the air that is supplied to the combustion engine or other heat source 106. For instance, the working fluid can be supplied to the exhaust heat exchanger 109 through the precooling heat exchanger 130 to precool the air supplied to the combustion engine or other heat source 106.

In some implementations, the air intake to the combustion engine can be sub-cooled below freezing. This can be accomplished using a glycol loop with a direct contact heat exchanger that utilizes ethylene/propylene glycol or other hydroscopic liquid with a low freezing point. The inlet air can be cooled by spraying, e.g., the glycol into a chamber through which the inlet air flows. Water vapor would be absorbed into the glycol at the same time that heat is removed from the inlet air. The glycol would then be processed to remove the water and chill the glycol before it returns to the spray chamber. In some embodiments, the heated glycol can be used as a heat source for the working fluid. For example, the heated glycol can be supplied to the precooling heat exchanger 130 where it is cooled by the working fluid.

The colder, denser air allows the fuel to be more thoroughly combusted. Precooling the air supplied to the combustion engine can allow for operation of the combustion engine with increased efficiencies. Ignition or detonation in the combustion engine occurs most readily at high ambient temperatures, and detonation limits the maximum compression ratio. For redesigned or updated combustion engines, a higher compression ratio can be utilized by cooling the air to a lower inlet temperature. For existing combustion engines, reducing the inlet temperature allows existing engine controls to vary, e.g., the spark advance and/or valve timing to operate more efficiently. In addition, heat from the ambient air is also used to initially warm up the working fluid before it enters the exhaust heat exchanger 109. By preheating the cryogenic fluid with the precooling heat exchanger, the cryogenic fluid may be heated to higher temperatures by the exhaust. This can result in greater energy production by the turbine generator 112 or other turbine.

Figure 5A:
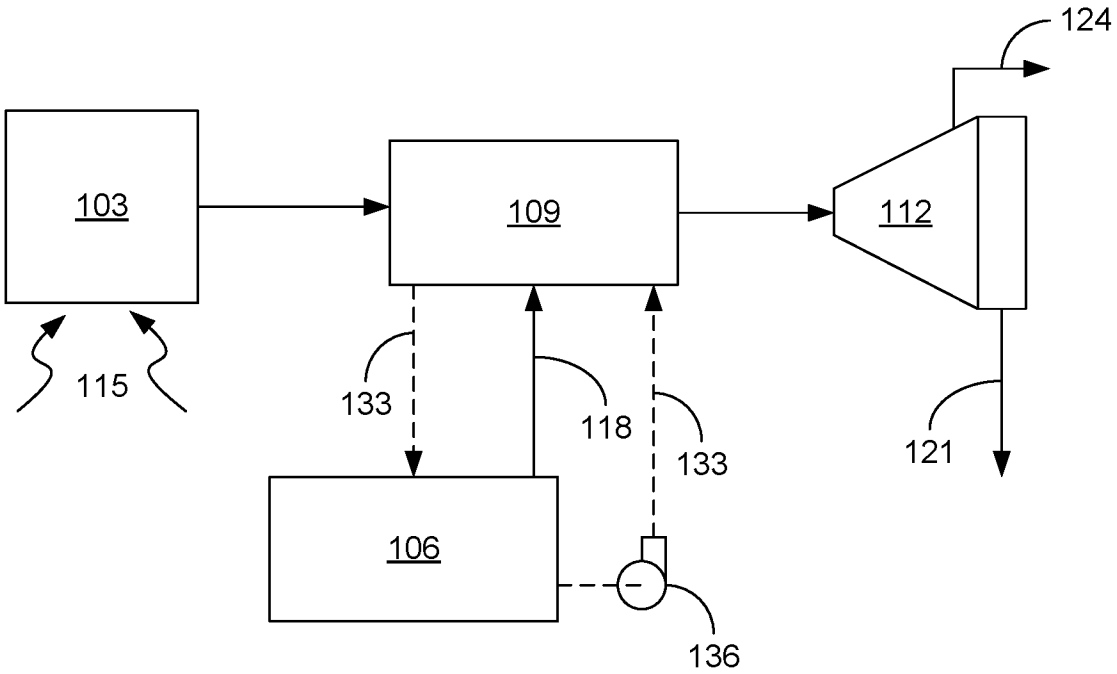
Figure 5B:
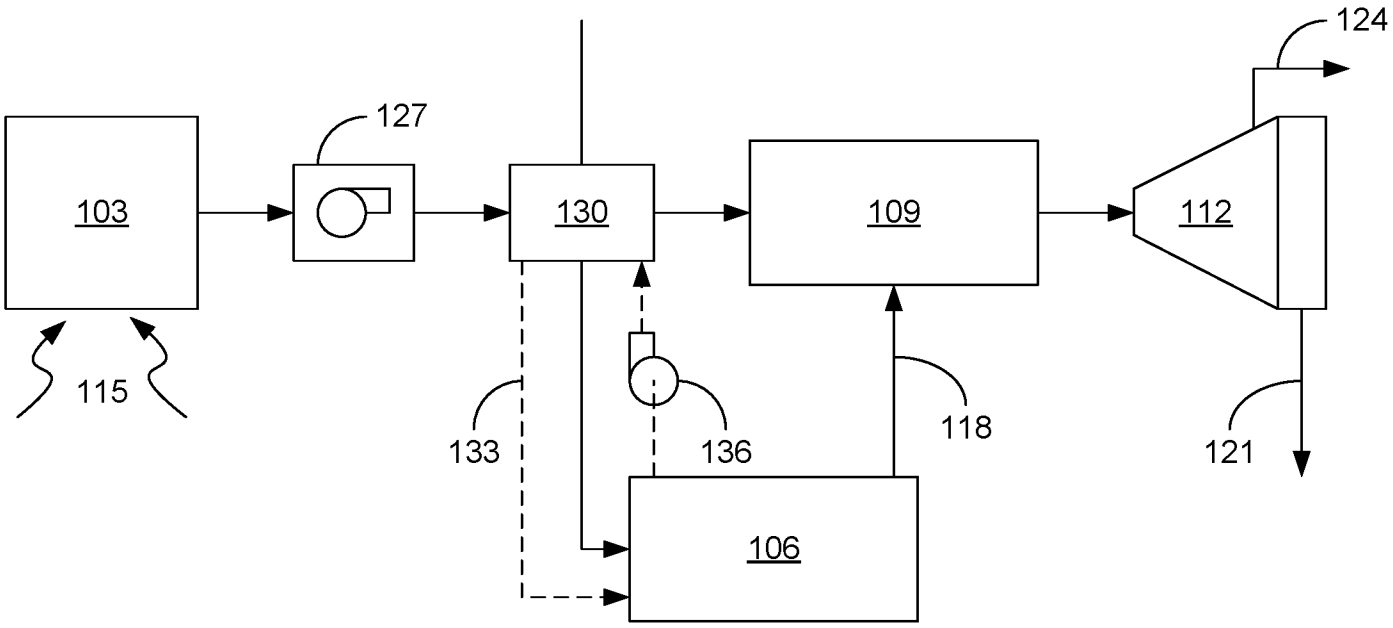

In a vehicle such as, e.g., a standard or hybrid electric car, truck, etc., storing a cryogen such as LN2 can, also provide a large cooling source, which could be used to replace of supplement other cooling systems in the vehicle. For example, a heat exchanger or other appropriate cooling device can be included between the supply tank 103 and the exhaust heat exchanger 109 to replace the air conditioning system of the vehicle. Elimination of the air conditioning system can also increase the overall system efficiency. The cryogenic fluid may also be used to augment or replace engine cooling for a combustion engine by decreasing or eliminating the losses through the radiator in the vehicle. In some cases, the radiator may be eliminated from the vehicle. The cryogenic fluid may also be used to provide cooling to achieve super conductivity, which can improve the efficiency of the vehicle's electrical system by reducing or eliminating losses. In some implementations, a coolant loop using a coolant such as, e.g., ethylene/propylene glycol or other hydroscopic liquid can be used to cool the heat source 106 (e.g., a combustion engine) and to heat the working fluid in the precooling heat exchanger 130, exhaust heat exchanger 109, or other heat exchanger. In some cases, the power generated by the turbine can be used to drive a coolant pump that circulates the coolant in the coolant loop. In this way, coolant flow can be maintained through the heat source 106 after shut down by using residual heat from the heat source 106 to generate power to drive the coolant pump. FIG. 5A illustrates an example of a coolant loop 133 including a coolant pump 136 to heat the working fluid in the exhaust heat exchanger 109, and FIG. 5B illustrates an example of a coolant loop 133 including a coolant pump 136 to heat the working fluid in the precooling heat exchanger 130.

It should be noted that a combustion engine operating as the heat source 106 could continue to operate without any working fluid flowing through the exhaust heat exchanger 109 and turbine of the cryogenic power extraction system 100. The exhaust produced by the combustion engine continues to flow through the exhaust heat exchanger 109 without cooling by the working fluid. In addition to losing the additional efficiency benefits, other minimal performance costs would include the weight of the empty system and the drag through the exhaust heat exchanger 109.

Power may also be generated using the cryogenic power extraction system 100 after the heat source stops operating. For example, a combustion engine continues to produce waste heat after the engine has been shut down. If the residual heat from the combustion engine continues to pass through the exhaust heat exchanger 109, then the working fluid will continue to be heated and used to generate power with the turbine generator 112 or other turbine. While the generated power reduces over time because of the cooling heat source 106, the power could be used to continue to charge the battery of the vehicle or supply other loads that remain after the combustion engine is turned off. For instance, a cooling pump may operate using the power from the residual heat to continue to circulate coolant through the combustion engine.

The vehicle could also operate with just LN2 using heating from the surrounding air, although with limited power due to limited heating capability of the LN2. A significant advantage, however, is that the LN2 system could provide a charge to a battery when the vehicle is not in use, using ambient heat. This would provide for a completely renewable energy source (using only LN2 to generate the power) that could be used to recharge electric vehicles, and would not require the large power grid improvements of electrical charging. The cryogenic power extraction system 100 can be used to extend the vehicle range for longer duration trips by allowing the battery to be recharged when it has been depleted.

The cryogenic power extraction system 100 can also use liquid natural gas (LNG) in place of, or in combination of the LN2, as the working fluid. Where LNG is used as the working fluid, the LNG could go through the same process as describe above however the exhausted LNG would be used as fuel for a combustion engine used as the heat source 106. For example, the LNG (or LH2) exhausted by the turbine generator 112 can be vented 124 back to the combustion engine and combined with the fuel for combustion. The process converts the LNG into natural gas that is ready for use by the combustion engine. Storing LNG is by itself more efficient than storing gaseous natural gas, as is done readily for public transportation. This can also increase the overall fuel efficiency of the cryogenic power extraction system 100.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

In an aspect, a system for cryogenic power extraction can comprise a heat exchanger and a turbine. The heat exchanger can be configured to heat a cryogenic working fluid using exhaust heat from a heat source and the turbine can be configured to generate power from the heated cryogenic working fluid. The cryogenic working fluid can be liquid nitrogen (LN2), liquid hydrogen (LH2), or other appropriate cryogenic fluid. The cryogenic fluid can be exhausted to the atmosphere after passing through the turbine. The heat source can be a combustion engine. The system can be in a vehicle (e.g., a hybrid electric car) that includes the combustion engine. The generated power can be used to charge a battery of the vehicle and/or drive a mechanical load of the vehicle.

In some aspects, the heat exchanger can heat the cryogenic working fluid using the exhaust heat generated during operation of the combustion engine. In other aspects, the heat exchanger can heat the cryogenic working fluid using residual exhaust heat from the combustion engine after operation has been stopped. A precooling heat exchanger can be configured to cool air supplied to the combustion engine with the cryogenic working fluid. A heat exchanger can be configured to cool air with the cryogenic working fluid. The air can be supplied for air conditioning of the vehicle. The cryogenic working fluid can be LNG, which can be supplied as fuel for the combustion engine after passing through the turbine.

A coolant loop can be configured to obtain at least a portion of the exhaust heat from the heat source and provide it to the heat exchanger. The coolant loop can utilize glycol to transport the exhaust heat from the heat source to the heat exchanger. A storage tank can be configured to store the cryogenic working fluid. In some aspects, an adjustable throttle valve can be configured to regulate the cryogenic working fluid supplied from the storage tank to the heat exchanger. In other aspects, a variable area turbine can be used to control use of the cryogenic working fluid. Control circuitry can be configured to monitor operating conditions of the system and regulate the adjustable throttle valve based at least in part upon the monitored operating conditions.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'"

Therefore, at least the following is claimed:

1. A system for cryogenic power extraction, comprising:

a first heat exchanger configured to heat a cryogenic working fluid using exhaust heat from a heat source, wherein the cryogenic working fluid is liquid nitrogen (LN2);

a second heat exchanger configured to heat the cryogenic working fluid using coolant heated by residual heat of the heat source after operation of the heat source has been stopped, the coolant circulated through the second heat exchanger and the heat source by a pump; and a turbine configured to generate power from the heated cryogenic working fluid, wherein the pump continues to circulate of the coolant after the operation of the heat source has been stopped using power generated by the turbine from the residual heat of the heat source.

2. The system of claim 1, wherein gas converted from the LN2 heated by the exhaust heat is exhausted to atmosphere after passing through the turbine.

3. The system of claim 1, wherein the heat source is a combustion engine.

4. The system of claim 3, wherein the system is in a vehicle including the combustion engine.

5. The system of claim 4, wherein the vehicle is a hybrid electric car.

6. The system of claim 4, wherein the generated power charges a battery of the vehicle.

7. The system of claim 4, wherein the generated power drives a mechanical load of the vehicle.

8. The system of claim 1, wherein the heat source is a combustion engine, and the first heat exchanger heats the cryogenic working fluid using the exhaust heat generated during operation of the combustion engine.

9. The system of claim 8, wherein the first heat exchanger heats the cryogenic working fluid using residual exhaust heat from the combustion engine after operation of the combustion engine has been stopped.

10. The system of claim 4, further comprising an air cooling heat exchanger configured to cool air with the cryogenic working fluid, where the air is supplied for air conditioning of the vehicle.

11. The system of claim 1, further comprising a coolant loop configured to obtain at least a portion of the exhaust heat from the heat source and provide the portion of the exhaust heat to the first heat exchanger.

12. The system of claim 11, wherein the coolant loop utilizes glycol to transport the portion of the exhaust heat from the heat source to the first heat exchanger.

13. The system of claim 1, further comprising a storage tank configured to store the cryogenic working fluid, the cryogenic working fluid provided from the storage tank to the first or second heat exchanger at a head pressure generated by ambient temperature.

14. The system of claim 13, further comprising an adjustable throttle valve configured to regulate the cryogenic working fluid supplied from the storage tank to the first or second heat exchanger, wherein power generation by the turbine is controlled by adjustment of the adjustable throttle valve.

15. The system of claim 14, further comprising control circuitry configured to monitor operating conditions of the system and regulate the adjustable throttle valve based at least in part upon the monitored operating conditions.

16. The system of claim 3, further comprising a precooling heat exchanger configured to cool ambient air supplied to the combustion engine with the cryogenic working fluid before the cryogenic working fluid is supplied to the first or second heat exchanger, the cooled ambient air directed from the precooling heat exchanger to the combustion engine.

* * * * *